US005866987A

United States Patent [19]

Wut

[11] Patent Number: 5,866,987

[45] Date of Patent: Feb. 2, 1999

[54] MOTION ACTIVATED ILLLUMINATING FOOTWEAR AND LIGHT MODULE THEREFOR WITH FADING AND MEANS FOR DEACTIVATING IN BRIGHT LIGHT

[75] Inventor: Siu Bun Wut, Hong Kong, Hong Kong

[73] Assignee: East Asia Services Ltd., Hong Kong, Hong Kong

[21] Appl. No.: 669,141

[22] Filed: Jun. 24, 1996

[51] Int. Cl.[6] ..... H05B 37/00

[52] U.S. Cl. ..... 315/119; 315/149; 362/103

[58] Field of Search ..... 352/91 C, 141; 315/150, 151, 156, 157, 158, 159, 119, 123, 125, 149; 362/103, 800, 802

[56] References Cited

U.S. PATENT DOCUMENTS

| | | | |
|---|---|---|---|
| 4,083,630 | 4/1978 | Mau | 352/91 C |
| 4,848,009 | 7/1989 | Rodgers . | |
| 5,303,485 | 4/1994 | Goldston et al. . | |
| 5,406,724 | 4/1995 | Lin . | |
| 5,408,764 | 4/1995 | Wut . | |
| 5,457,900 | 10/1995 | Roy . | |
| 5,461,188 | 10/1995 | Drago et al . | |
| 5,477,435 | 12/1995 | Rapisarda et al. . | |
| 5,495,682 | 3/1996 | Chen . | |
| 5,502,903 | 4/1996 | Barker . | |

*Primary Examiner*—Don Wong
*Assistant Examiner*—David H. Vu
*Attorney, Agent, or Firm*—Richard M. Goldberg

[57] ABSTRACT

Footwear includes a heel; an upper; a light source mounted to at least one of the heel and upper; and a light module positioned within the heel, the light module including a power supply for supplying power; a capacitor for storing power from the power supply and for discharging the stored power, the capacitor being connected with the light source to activate the light source; a switch for alternately opening and closing a connection between the power supply and the capacitor upon movement of the footwear, such that when the switch closes the connection, the capacitor charges to a full capacity thereof as determined by the power supply, and the light source is activated to emit light at a first intensity in accordance with the full capacity of the charge on the capacitor, and when the switch opens the connection, the capacitor discharges from the full capacity thereof, and the light source is activated to emit light at an intensity less than the first intensity and which decreases over time, in accordance with the discharge, to produce a fading effect; and a photosensor for sensing ambient light and for preventing activation of the light source when the photosensor senses ambient light of an intensity greater than a predetermined intensity, regardless of whether the switch is open or closed.

29 Claims, 5 Drawing Sheets

MOTION ACTIVATED ILLLUMINATING FOOTWEAR AND LIGHT MODULE THEREFOR WITH FADING AND MEANS FOR DEACTIVATING IN BRIGHT LIGHT

BACKGROUND OF THE INVENTION

This invention relates to footwear, and more particularly, is directed to motion activated illuminating footwear having a light module therein.

It is well known to position a light inside of a heel of footwear, with the light being activated all of the time. In such known construction, the light can be turned off by means of a switch extending from the heel of the footwear. See, for example, U.S. Pat. No. 4,253,253 to McCormick. However, this construction provides certain disadvantages. First, there is the possibility that the switch is not turned off, in which case the light will burn out in a very short period of time. Second, a connection must be made between the switch on the outside of the heel to the circuitry within the heel, which adds to the cost and complexity of the footwear. Third, there is the possibility that the switch can be damaged, for example, by banging the shoe against an object, since the switch is externally accessible.

For the above reasons, it is preferred to position the entire circuitry and switch therefor entirely within the heel of the footwear. In this regard, it is well known to position a light, such as a light emitting diode (LED) inside of the heel of footwear, such that the light is visible from the exterior of the footwear, with the light being activated by means of a pressure sensitive switch. In particular, when the wearer steps down and exerts pressure on the pressure sensitive switch when walking or running, a circuit is closed so as to supply power to activate the LED. When the wearer steps up, relieving pressure from the pressure sensitive switch, the circuit is opened so as disconnect power to the LED. Examples of such footwear are disclosed in U.S. Pat. Nos. 5,188,447 to Chiang et al, European Pat. Application No. 0 121 026, and U.S. Pat. No. 3,800,133 to Duval. However, the use of a pressure sensitive switch and the associated circuit connections increases the cost and complexity of the footwear.

It is also known to position a light inside of the heel of footwear, with the light being activated by a mercury tilt switch in the footwear. See, for example, German Offenlegungsschrift No. 2,608,485, the aforementioned European Patent Application No. 0 121 026, U.S. Pat. No. 4,158,922 to Dana, III, U.S. Pat. No. 4,848,009 to Rodgers and U.S. Pat. No. 3,893,247 to Dana, III. However, the addition of the mercury tilt switch and the associated circuitry greatly adds to the cost and complexity of the footwear.

U.S. Pat. No. 5,408,764 to Wut, the entire disclosure or which is incorporated herein by reference, discloses the use of an LED inside of the heel of a shoe, and which is intermittently activated by movement of the shoe. Specifically, when the shoe is moved, the free end of a coil spring which is fixed in a cantilevered manner, is caused to intermittently complete the electrical circuit to supply current to the LED.

However, the LED is activated at all times, that is, even in the daytime. Since illumination by the LED is not noticeable during the daytime, such illumination is wasteful and results in unnecessary usage of the battery.

Further, with all of the above assemblies, the LED is either entirely off or on at a set intensity. In other words, there are no times when the LED is illuminated at different intensities.

U.S. Pat. No. 5,406,724 discloses footwear which uses a photoresistive switch connected between the battery and the LEDs so that the LEDs are only lit at night or darkness for saving power consumption of the battery. However, this device does not disclose illumination at different or varied intensities, let alone in conjunction with the photoresistive switch.

OBJECTS AND SUMMARY OF THE INVENTION

Accordingly, it is an object of the present invention to provide motion activated illuminating footwear that overcomes the problems with the aforementioned prior art.

It is another object of the present invention to provide motion activated illuminating footwear having a fading effect in which the light produces an illumination of decreasing intensity.

It is still another object of the present invention to provide motion activated illuminating footwear in which the light is prevented from being turned on when the environment has at least a predetermined brightness, and provided in conjunction with the fading effect.

It is yet another object of the present invention to provide motion activated illuminating footwear in which a spring intermittently connects the battery as a result of vibration caused by movement of the footwear, so as to intermittently turn the light on and off.

It is a further object of the present invention to provide motion activated illuminating footwear in which the spring is not in direct contact with the battery.

It is a still further of the present invention to provide motion activated illuminating footwear that does not require any costly and complex circuitry.

In accordance with an aspect of the present invention, light module for use with a light source mounted to footwear, includes a power supply for supplying power; a capacitor for storing power from the power supply and for discharging the stored power, the capacitor being connected with the light source to activate the light source; and a switch for opening and closing a connection between the power supply and the capacitor. When the switch closes the connection, the capacitor charges to a full capacity thereof as determined by the power supply, and the light source is activated to emit light at a first intensity in accordance with the full capacity of the charge on the capacitor, and when the switch opens the connection, the capacitor discharges from the full capacity thereof, and the light source is activated to emit light at an intensity less than the first intensity and which decreases over time, in accordance with the discharge, to produce a fading effect.

The switch intermittently provides electrical connection between the power supply and the capacitor upon movement of the module. The switch includes a coil extension spring connected in a cantilevered manner such that one end of the spring is electrically connected to one of the capacitor and the power supply and an opposite free end of the spring intermittently electrically connects with the other of the capacitor and the power supply upon movement of the module, to provide opening and closing of the switch.

Preferably, a weight is supported by the free end of the spring to enhance contact of the free end with a contact electrically connected with the other of the capacitor and the power supply during the intermittent electrical connection.

Resistors are provided for determining a timing of the discharge from the capacitor, the resistors being connected between the capacitor and the light source.

The module further includes a driving transistor having an output path connected with the light source, and an input; and wherein the resistor is connected between the capacitor and the input of the driving transistor. Preferably, the driving transistor is a bipolar junction transistor having a base as the input and a collector-emitter path as the output path connected in series with the light source; and the resistor includes a first resistive element connected between one terminal of the capacitor and the base of the driving transistor, and a second resistive element connected between an opposite terminal of the capacitor and the base of the driving transistor, and specifically, the second resistive element is connected in parallel with a base-emitter path of the driving transistor.

In accordance with another aspect of the present invention, a light module for use with a light source mounted to footwear, includes a power source for supplying power; a switch for intermittently providing electrical connection of the power source to the light source upon movement of the module; and a photosensor for sensing ambient light and for preventing activation of the light source when the photosensor senses ambient light of an intensity greater than a predetermined intensity, regardless of whether the switch provides the electrical connection, the photosensor including a photoconductive sensor having an internal resistance of at least a first value when the ambient light is less than the predetermined intensity and which decreases from the first value with increasing intensity of the ambient light, and a transistor for preventing activation of the light source in response to sensing of the intensity of the ambient light greater than the predetermined intensity, regardless of whether the switch provides the electrical connection, the transistor including an output path for supplying power from the power source to activate the light source, and an input, and the photoconductive sensor is connected across the output path of the transistor, and has an input connected to the input of the transistor, such that upon sensing the ambient light of an intensity less than the predetermined intensity, the photoconductive sensor has an internal resistance of at least the first value, to substantially prevent flow of current therethrough, whereupon current flows to the input of the transistor to turn the transistor on to permit the supply of power through the output path thereof and to activate the light source, and upon sensing the ambient light of an intensity greater than the predetermined intensity, the photoconductive sensor has the internal resistance less than the first value to permit flow of current therethrough, whereupon current flows primarily through the photoconductive sensor rather than through the input of the transistor, and the transistor is turned off to prevent the supply of power through the output path thereof to prevent activation of the light source.

Preferably, the latter transistor is a bipolar junction transistor having a base, an emitter and a collector, and further comprising a first resistive element connected between the collector and an input of the photoconductive sensor and a second resistive element connected between the emitter and an output of the photoconductive sensor.

In accordance with still another aspect of the present invention, a light module for use with a light source mounted to footwear, includes a power supply for supplying power; a capacitor for storing power from the power supply and for discharging the stored power, the capacitor being connected with the light source to activate the light source; a switch for alternatively opening and closing a connection between the power supply and the capacitor upon movement of the module, such that when the switch closes the connection, the capacitor charges to a full capacity thereof as determined by the power supply, and the light source is activated to emit light at a first intensity in accordance with the full capacity of the charge on the capacitor, and when the switch opens the connection, the capacitor discharges from the full capacity thereof, and the light source is activated to emit light at an intensity less than the first intensity and which decreases over time, in accordance with the discharge, to produce a fading effect; and a photosensor for sensing ambient light and for preventing activation of the light source when the photosensor senses ambient light of an intensity greater than a predetermined intensity, regardless of whether the switch is open or closed.

In accordance with yet another aspect of the present invention, footwear includes a heel; an upper; a light source mounted to at least one of the heel and the upper; and a light module positioned within the heel, the light module including a power supply for supplying power; a capacitor for storing power from the power supply and for discharging the stored power, the capacitor being connected with the light source to activate the light source; and a switch for opening and closing a connection between the power supply and the capacitor such that when the switch closes the connection, the capacitor charges to a full capacity thereof as determined by the power supply, and the light source is activated to emit light at a first intensity in accordance with the full capacity of the charge on the capacitor, and when the switch opens the connection, the capacitor discharges from the full capacity thereof, and the light source is activated to emit light at an intensity less than the first intensity and which decreases over time, in accordance with the discharge, to produce a fading effect.

In accordance with a further aspect of the present invention, footwear includes a heel; an upper; a light source mounted to at least one of the heel and the upper; and a light module positioned within the heel, the light module including a power source for supplying power; a switch for intermittently providing electrical connection of the power source to the light source upon movement of the footwear; and a photosensor for sensing ambient light and for preventing activation of the light source when the photosensor senses ambient light of an intensity greater than a predetermined intensity, regardless of whether the switch provides the electrical connection, the photosensor including a photoconductive sensor having an internal resistance of at least a first value when the ambient light is less than the predetermined intensity and which decreases from the first value with increasing intensity of the ambient light, and a transistor for preventing activation of the light source in response to sensing of the intensity of the ambient light greater than the predetermined intensity, regardless of whether the switch provides the electrical connection, the transistor including an output path for supplying power from the power source to activate the light source, and an input, and the photoconductive sensor is connected across the output path of the transistor, and has an input connected to the input of the transistor, such that upon sensing the ambient light of an intensity less than the predetermined intensity, the photoconductive sensor has an internal resistance of at least the first value, to substantially prevent flow of current therethrough, whereupon current flows to the input of the transistor to turn the transistor on to permit the supply of power through the output path thereof and to activate the light source, and upon sensing the ambient light of an intensity greater than the predetermined intensity, the photoconductive sensor has the internal resistance less than the first value to permit flow of current therethrough, whereupon current flows primarily through the photoconductive sensor rather than through the input of the transistor, and the transistor is turned off to prevent the supply of power through the output path thereof to prevent activation of the light source.

In accordance with a still further aspect of the present invention, footwear includes a heel; an upper; a light source mounted to at least one of the heel and the upper; and a light module positioned within the heel, the light module including a power supply for supplying power; a capacitor for storing power from the power supply and for discharging the stored power, the capacitor being connected with the light source to activate the light source; a switch for alternately opening and closing a connection between the power supply and the capacitor upon movement of the footwear, such that when the switch closes the connection, the capacitor charges to a full capacity thereof as determined by the power supply, and the light source is activated to emit light at a first intensity in accordance with the full capacity of the charge on the capacitor, and when the switch opens the connection, the capacitor discharges from the full capacity thereof, and the light source is activated to emit light at an intensity less than the first intensity and which decreases over time, in accordance with the discharge, to produce a fading effect; and a photosensor for sensing ambient light and for preventing activation of the light source when the photosensor senses ambient light of an intensity greater than a predetermined intensity, regardless of whether the switch is open or closed.

The above and other objects, features and advantages of the invention will become readily apparent from the following detailed description thereof which is to be read in connection with the accompanying drawings.

DETAILED DESCRIPTION OF THE PREFERRED EMBODIMENTS

Figure 1:
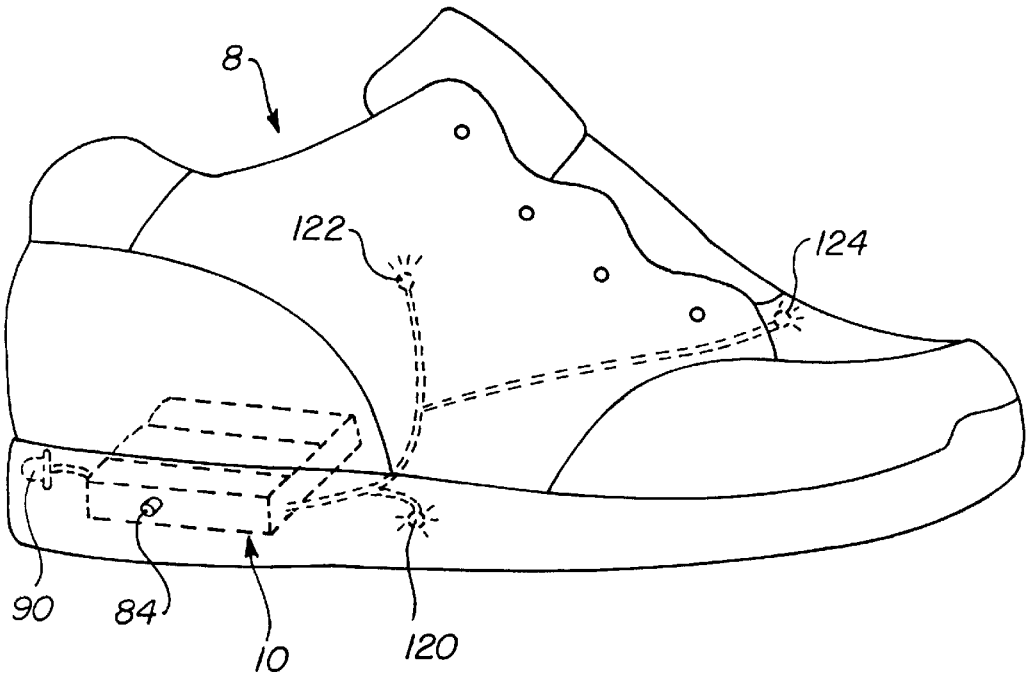
FIG. 1 is a perspective view of a running shoe, with the location of the light module shown in phantom therein.

Referring to the drawings in detail, and initially to FIGS. 1–5 thereof, footwear 8 such as a running shoe or the like includes a light module 10, according to a first embodiment of the present invention, incorporated into the heel of the footwear, in a similar manner to U.S. Pat. No. 5,408,764.

Light module 10 includes a plastic housing 12 including a rectangular bottom wall 14, a front wall 16, a rear wall 18, a right side wall 20 and a top wall 22. Side walls 16, 18 and 20 form a rectangular enclosure having the same dimensions as bottom wall 14 and are secured thereto. The left side 24 is entirely open so that circuitry 26, which will be described hereinafter, can be mounted therein. Further, top wall 22 has a large opening 28 through which two batteries 30 and 31 can be inserted into a battery compartment 32 in housing 12 for powering the circuitry. Batteries 30 and 31 can, for example, be AAA batteries, although the present invention is not limited thereto. Housing 12 can be made of any suitable material, but is preferably made from an acrylic material.

Batteries 30 and 31 are connected in series in battery compartment 32, as will now be described, to form a power supply 33.

A projecting wall 34 having an H-shaped cross-section in a horizontal plane, extends inwardly from the inner surface of rear wall 18, at a position which substantially bisects battery compartment 32. Accordingly, projecting wall 34 includes oppositely facing vertical slits 36 and 38 which are parallel to rear wall 18. The height of projecting wall 34, and thereby of slits 36 and 38, is slightly less than the height of rear wall 18. A vertical slit 40 is provided in right side wall 20 in alignment with and parallel to vertical slit 36, and a vertical alignment stub wall 42 extends the full height of housing 12 and is secured between bottom wall 14 and top wall 22 at the left side of opening 28 and in alignment with the front edge of projecting wall 34.

With this arrangement, a first metal plate 44 having a coil spring 46 extending therefrom is held within vertical slits 36 and 40, such that coil spring 46 contacts the negative terminal of battery 30, while a second metal plate 48 having a raised battery contact portion 50 is held within vertical slit 38 and restrained by vertical alignment wall 42, such that raised battery contact portion 50 contacts the positive terminal of battery 31.

Two inwardly directed short walls 52 and 54, each having a height which is the same as housing 12, extend in slightly spaced relation to the inner surface of front wall 16, and at opposite sides of battery compartment 32, so as to define two opposing vertical slits 56 and 58. A metal plate 60 is held within vertical slits 56 and 58, with metal plate 60 including a raised battery contact portion 62 which contacts the positive terminal of battery 30 and a coil spring (not shown) which contacts the negative terminal of battery 31.

In this manner, batteries 30 and 31 are connected in series, with the input and output thereof being taken across metal plates 44 and 48. Thus, a wire 64 has one end connected to metal plate 44, and a wire 66 has one end connected to metal plate 46, in order to power circuitry 26.

A printed circuit board 68 is provided for mounting in housing 12 through open left side 24. Circuitry 26 includes a capacitor 70, four resistors 72, 74, 76 and 78, and two transistors 80 and 82 mounted on printed circuit board 68, in a manner which will be described hereinafter.

Figure 2:
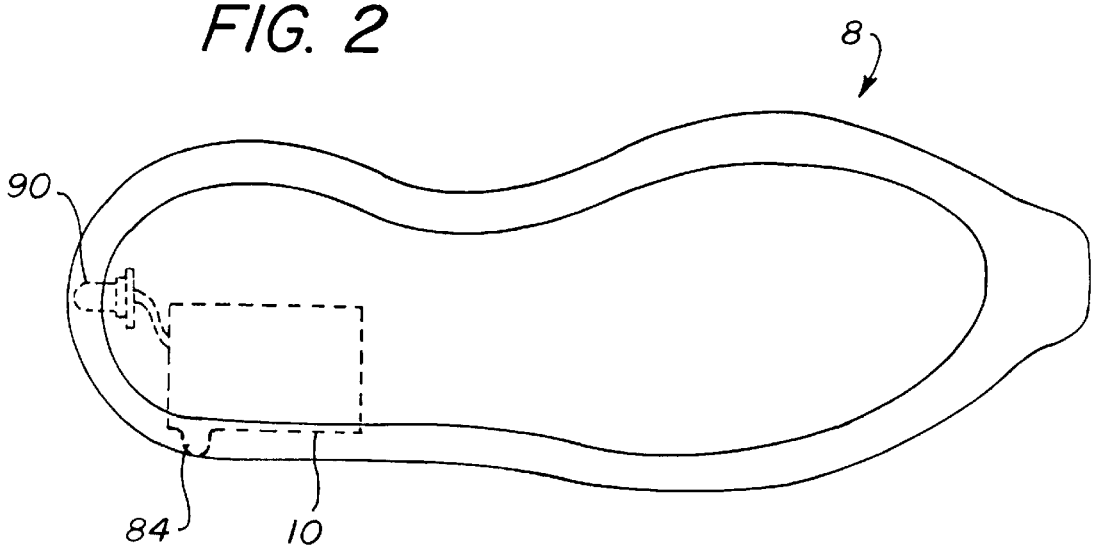
FIG. 2 is a bottom plan view of the running shoe of FIG. 1, with the light module shown in phantom therein.

Further, circuitry 26 includes a photosensor 84 mounted on a printed circuit board 86 and connected to various circuit elements on printed circuit board 68 by means of wires 87 and 88. Preferably, photosensor 84 is a photoconductive diode sensor. Printed circuit board 86 is arranged such that photosensor 84 is exposed to light at the side of footwear 8, as shown in FIGS. 1 and 2, to detect bright light such as daylight or darkness such as nighttime. Printed circuit board 86 is mounted in housing 12 through open left side 24.

Still further, circuitry 26 includes a light source 90, such as a red light emitting diode (LED) mounted on a printed circuit board 92 and connected to various circuit elements on printed circuit board 68 by means of wires 94 and 96. LED 90 is intended to be illuminated only when light is below a threshold value, for example, at night, and only in the manner specified hereinafter. It is preferred to use a light emitting diode for the light source since an LED provides a relatively high intensity with a relatively low energy consumption when compared with other conventional incandescent illumination devices. The low energy consumption enables the use of a smaller size and less costly battery compared to other light sources. This size reduction is of utmost importance in footwear. Further, LEDs are also available in assorted color lightings.

Figure 5:
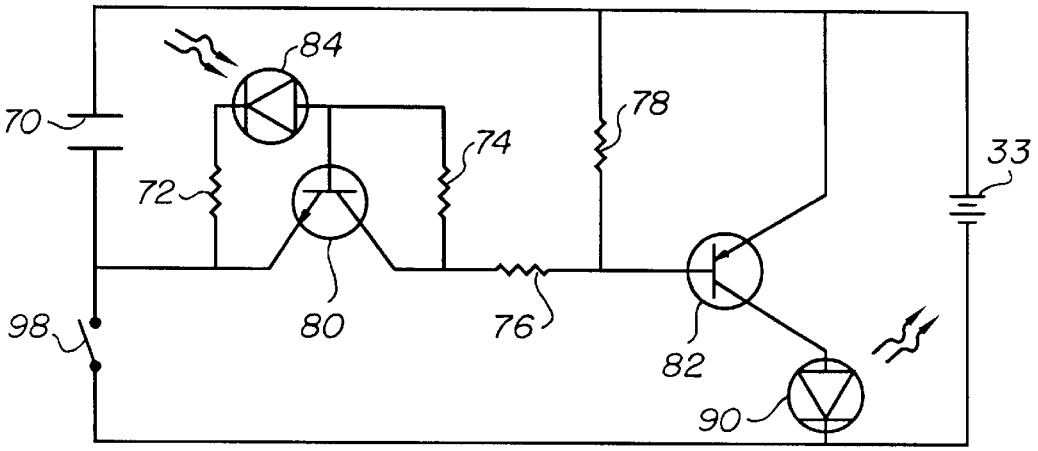
FIG. 5 is a circuit wiring diagram showing the equivalent electric circuitry for the light module of FIG. 3.
Figure 4:
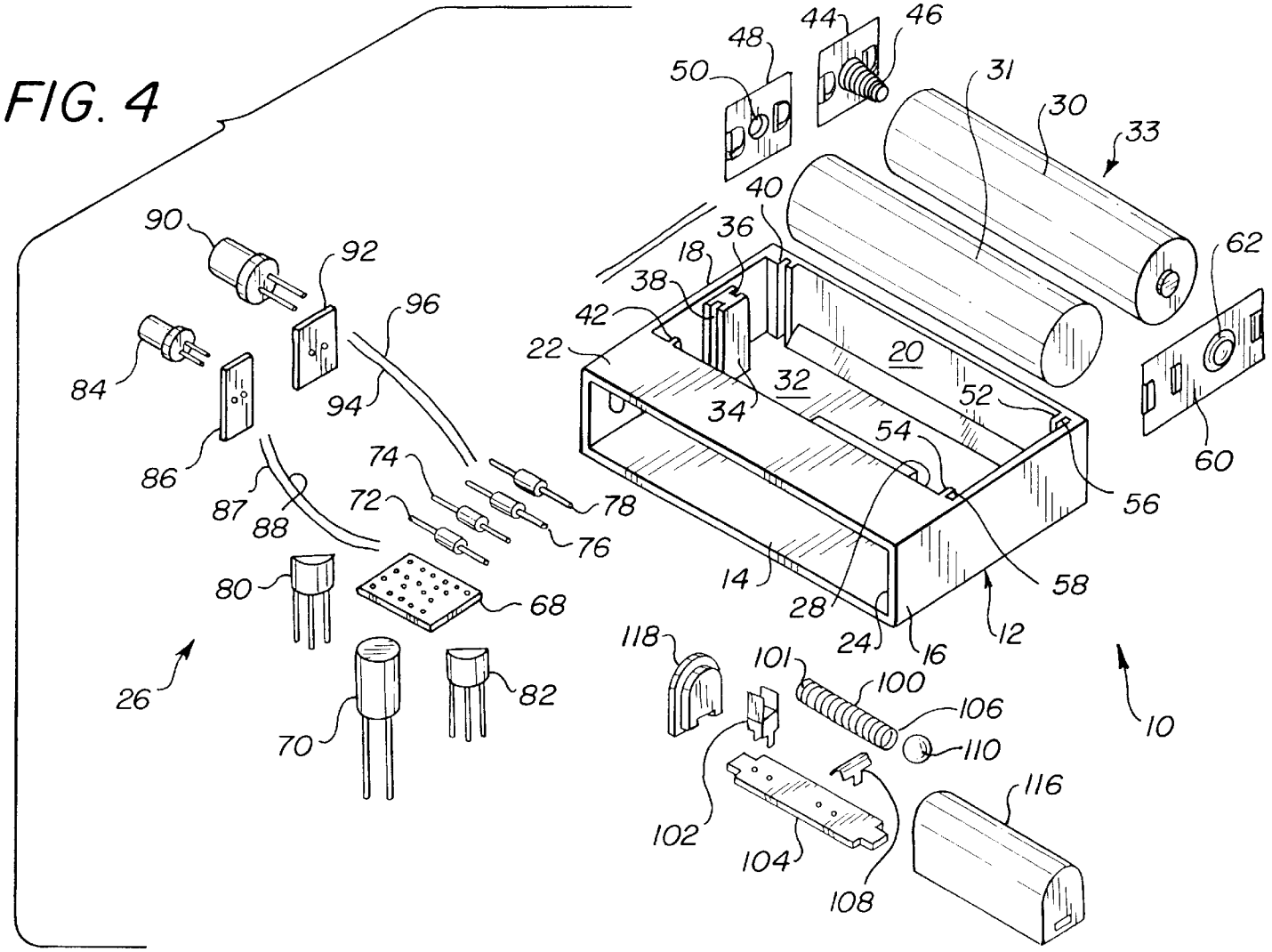
FIG. 4 is a fully exploded perspective view of a light module of FIG. 3.

The last circuit element of circuitry 26 is a switch 98 illustrated schematically in the circuit of FIG. 5. Switch 98 is formed by a coil spring 100 having one end 101 thereof fixedly mounted to a spring holder 102 that is mounted to one end of an elongated printed circuit board 104. The opposite end 106 of coil spring 100 is free, such that coil spring 100 is mounted in a cantilevered manner on printed circuit board 104. Specifically, the opposite free end 106 of coil spring 100 is mounted in spaced relation above a metal arch 108 that is fixed to the opposite end of printed circuit board 104. A weighting ball 110 is secured to the free end 106 of coil spring 100 to ensure that in the stationary position of footwear 8, free end 106 is positioned slightly above, but in spaced relation to, metal arch 108.

Spring holder 102 and thereby the fixed end 101 of coil spring 100, are connected by electric wire 112 to printed circuit board 68, while metal arch 108 and thereby free end 106 of coil spring 100 when it contacts metal arch 108, are also connected by electric wire 114 to printed circuit board 68.

Coil spring 100 and printed circuit board 108 are enclosed by an arcuate spring housing 116 having an end closure cap 118. Printed circuit board 68 can be secured to spring housing 116 or end closure cap 118 to provide a unitary assembly.

The schematic circuit diagram with all connections for circuitry 26 is shown in FIG. 5.

Specifically, transistor 80 is shown as an NPN bipolar junction transistor, although it is not so limited. Transistor 80 is connected in a common-base configuration, with a series circuit of resistor 74, diode photosensor 84 and resistor 72, connected between the collector and emitter of transistor 80, and with the base of transistor 80 being connected to the junction of resistor 74 with photosensor 84. Resistor 78 is connected between the base of transistor 82 and the positive terminal of power supply 33.

Photosensor 84 is provided to detect the brightness of the surrounding environment, and is set for a predetermined brightness.

With such arrangement, during daylight, that is, when the surrounding environment is brighter than the predetermined brightness set for photosensor 84, the internal resistance of photosensor 84 decreases. Thus, current will flow through the path of resistor 74, photosensor 84 and resistor 72, and not through the base of transistor 80. As a result, transistor 80 will be turned off, so that no current will flow through the emitter-collector path thereof.

During this time, when switch 98 is closed, the voltage supply will begin from the positive terminal of power supply 33, and then through the base-emitter path of transistor 82, resistors 78, 76 and 74, photosensor 84, resistor 72, switch 98 and back to the negative terminal of power supply 33. However, this voltage supply is weak and is insufficient to turn on the emitter-collector paths of transistors 80 and 82. Thus, LED 90 will not be activated to emit light.

On the other hand, at night, when photosensor 84 is not illuminated with bright light of at least a predetermined brightness, the internal resistance of photosensor 84 increases. Due to the high resistance of photosensor 84 and resistor 72, only a small portion of current flows through photosensor 84 and resistor 72. At this time, the current will therefore flow through the base of transistor 80, to turn on transistor 80, with the major portion of current then flowing through the emitter-collector path of transistor 80.

The collector of transistor 80 is connected through resistor 76 to the base of transistor 82, which is shown as a PNP bipolar junction transistor, although it is not limited to the same. The emitter of transistor 82 is connected to the positive terminal of power supply 33, while the collector is connected through LED 90 to the negative terminal of power supply 33.

During daylight, when transistor 80 is off, no current flows through the emitter-collector path of transistor 80 to the base of transistor 82. Accordingly, transistor 82 is turned off. This means that no current is permitted to flow through the emitter-collector path of transistor 82, so that LED 90 is turned off during the daytime.

During the night, when transistor 80 is on, current flows through the emitter-collector path of transistor 80 to the base of transistor 82. Accordingly, transistor 82 is turned on. This means that current is permitted to flow through the emitter-collector path of transistor 82, so that LED 90 can be turned on during the night.

In particular, switch 98 is connected at one end through capacitor 70 to the positive terminal of power supply 33 and to the emitter of transistor 82, and at its opposite end to the negative terminal of power supply 33 and to LED 90. Thus, the circuit is completed only when switch 98 is closed, that is, when the free end 106 of spring 100 contacts metal arch 108.

Figure 3:
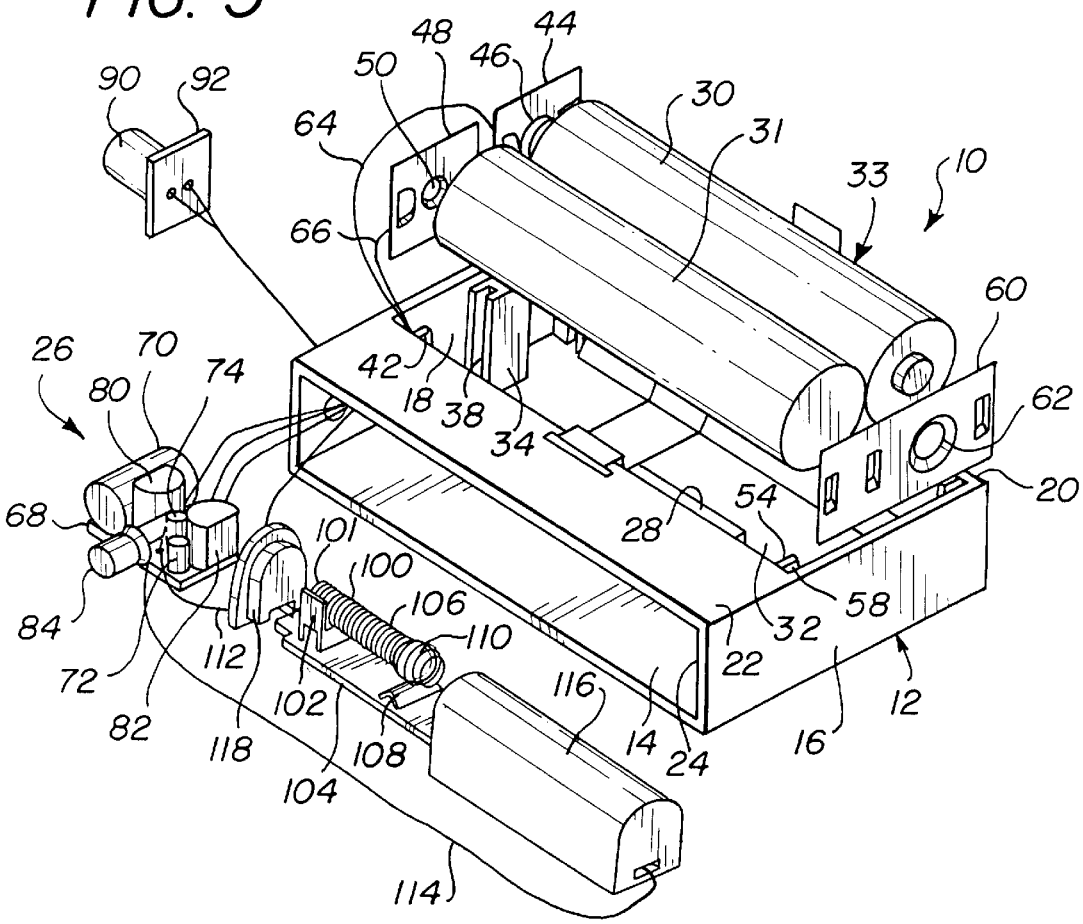
FIG. 3 is a partially exploded perspective view of a light module of the motion activated illuminating footwear according to the present invention.

Accordingly, when light module 10 is in equilibrium, that is, in a static state when footwear 8 is stationary, free end 106 of coil extension spring 100 is designed not to contact battery metal arch 108. In other words, coil extension spring 100 has a sufficient stiffness so that free end 106 extends horizontally above the upper surface of metal arch 108, as shown in FIG. 3. Thus, no power is supplied to LED 90, and LED 90 will not be illuminated.

However, during the night, when light module 10 is activated by a simple up and down motion, such as occurs in a stepping motion, this motion will vibrate coil extension spring 100, and the vibrating coil extension spring 100 will contact the upper surface of metal arch 108 with each vibration. Each time that coil extension spring 100 contacts metal arch 108, the circuit will be closed and power will be supplied to LED 90 to cause the same to emit light visible to human eyes.

It will be appreciated that each vibration will connect power supply 33, that is, batteries 30 and 31, to LED 90, and also, will function to disconnect power supply 33 from LED 90. Thus, when light module 10 is activated by motion, the circuit will alternate between an ON state and an OFF state. Specifically, in the ON state, coil extension spring 100 contacts metal arch 108 when coil extension spring 100 is moving in a downward motion, which will close the circuit of light module 10.

However, when coil extension spring 100 is in its upward motion, coil extension spring 100 is not in contact with metal arch 108. This upward motion of coil extension spring 100 will open the circuit of light module 10, so that LED 90 will not be illuminated.

Thus, each time the circuit completes these two ON and OFF states, LED 90 will emit light so as to simulate a flashing light. When the circuit is opened and closed by the sequential vibrations of motion, for example, while the person is walking, LED 90 will emit a series of flashes, which will have a flashing effect visible to human eyes.

Weighting ball 110 is added to free end 106 of coil extension spring 100 to add weight thereto and thereby enhance the downward motion which will provide a better connection between coil extension spring 100 and metal arch 108. This better connecting relation between coil extension spring 100 and metal arch 108 provides LED 90 with a more stable power source which, in turn, provides a higher degree of illumination for LED 90. Thus, weighting ball 110 provides a more reliable connecting relation between coil extension spring 100 and metal arch 108, without affecting the upward motion of each vibration. Of course, the characteristics of coil extension spring 100, such as the thickness of the spring and the like, will have to be taken into account to determine the effects of weighting ball 110.

In addition to LED 90 only being capable of being activated at night (or in a dark environment), a fading effect is provided when LED 90 is turned on. Specifically, in darkness, when switch 98 is closed, LED 90 is turned on with a constant intensity of illumination, since LED 90 is powered by capacitor 70 which is fully charged to the voltage of constant power supply 33. However, when switch 98 is opened, LED 90 is powered by the discharge from capacitor 70. Since capacitor 70 is charged when switch 98 is closed, the voltage of capacitor at such time is the same as that of power supply 33. However, when switch 98 is opened, power supply 33 is disconnected, and accordingly, capacitor 70 is discharged to power LED 90. As the voltage decreases during such discharge, the intensity of illumination of LED 90 will consequently decrease. This produces a fading effect, until switch 98 is again closed, whereby the full power of power supply 33 is once again supplied to LED 90. The discharge rate of capacitor 70 is determined by resistors 76 and 78. Hereinafter, reference to a power source will mean the combination of the power supply 33 and capacitor 70, which in combination, provide power to activate LED 90.

Although capacitor 70 will discharge through the emitter-collector path of transistor 82 when switch 98 is open at night, the major portion of the discharge through the circuit travels from capacitor 70, through resistors 78 and 76 and through the collector-emitter path of transistor 80, and back to capacitor 70.

Of course, if footwear 8 moves to a stationary position, capacitor 70 will entirely discharge, and since switch 98 will be open, LED 90 will not be illuminated at all.

In operation, when the surrounding environment detected by photosensor 84 is dark or close to dark, transistor 80 is turned on to permit current flow through the emitter-collector path thereof. When switch 98 is closed, there will be a closed circuit from the positive terminal of power supply 33, through resistors 78 and 76, through transistor 80 and to the negative terminal of power supply 33. This has the effect of turning on transistor 82, whereby LED 90 is powered to emit light in accordance with the full charge on capacitor 70.

When switch 98 is open, that is, free end 106 of spring 100 is not in contact with metal arch 108, the circuit by which capacitor 70 was charged, is broken. Due to the current supplied from capacitor 70 through the emitter-collector path of transistor 80, transistor 82 is retained in its on state. Further, capacitor starts discharging from its full state to a lesser charge. As the charge reduces, the amount of light emitted by LED 90 reduces, to achieve a fading or dimming effect. The rate of discharge of capacitor 70 will depend upon the resistance value of resistors 76 and 78 and on transistor 82.

When capacitor 70 is fully discharged, and switch 98 is open, LED 90 will stop emitting light completely.

When the surrounding environment detected by photosensor 84 is bright, transistor 80 is turned off to prevent current flow through the emitter-collector path thereof.

Thus, the following important aspects are achieved by the present invention:

(a) coil spring 100 is positioned out of direct contact with batteries 30 and 31;

(b) a fading effect is achieved; and (c) no illumination by LED 90 will occur when there is a bright environment.

As an alternative embodiment, as shown in FIG. 1, one or more of LEDs 120, 122 and 124 can be added to circuitry 26 in place or, or in addition to, LED 90. As shown, LED 120 is placed at a lower side portion of footwear 8, LED 122 is placed at an upper side portion of footwear 8, and LED 124 is placed on an upper front portion of footwear 8. In such case, the wiring is placed between the material of the upper of footwear 8 so that the wiring will not be exposed, and the LED is secured to the side and top portions of footwear 8 with glue.

Figure 6:
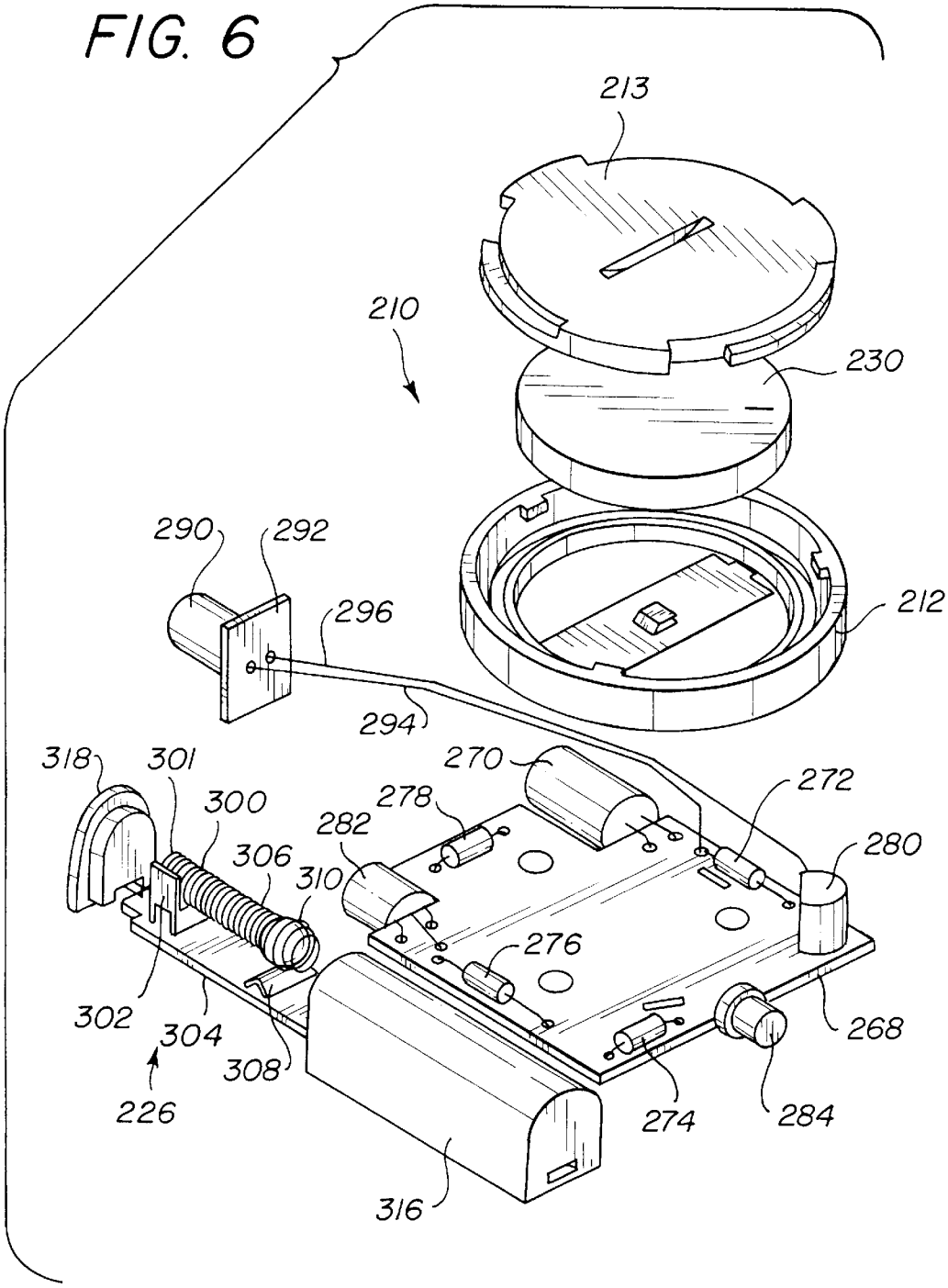
FIG. 6 is a partially exploded perspective view of a light module of the motion activated illuminating footwear according to another embodiment of the present invention.
Figure 7:
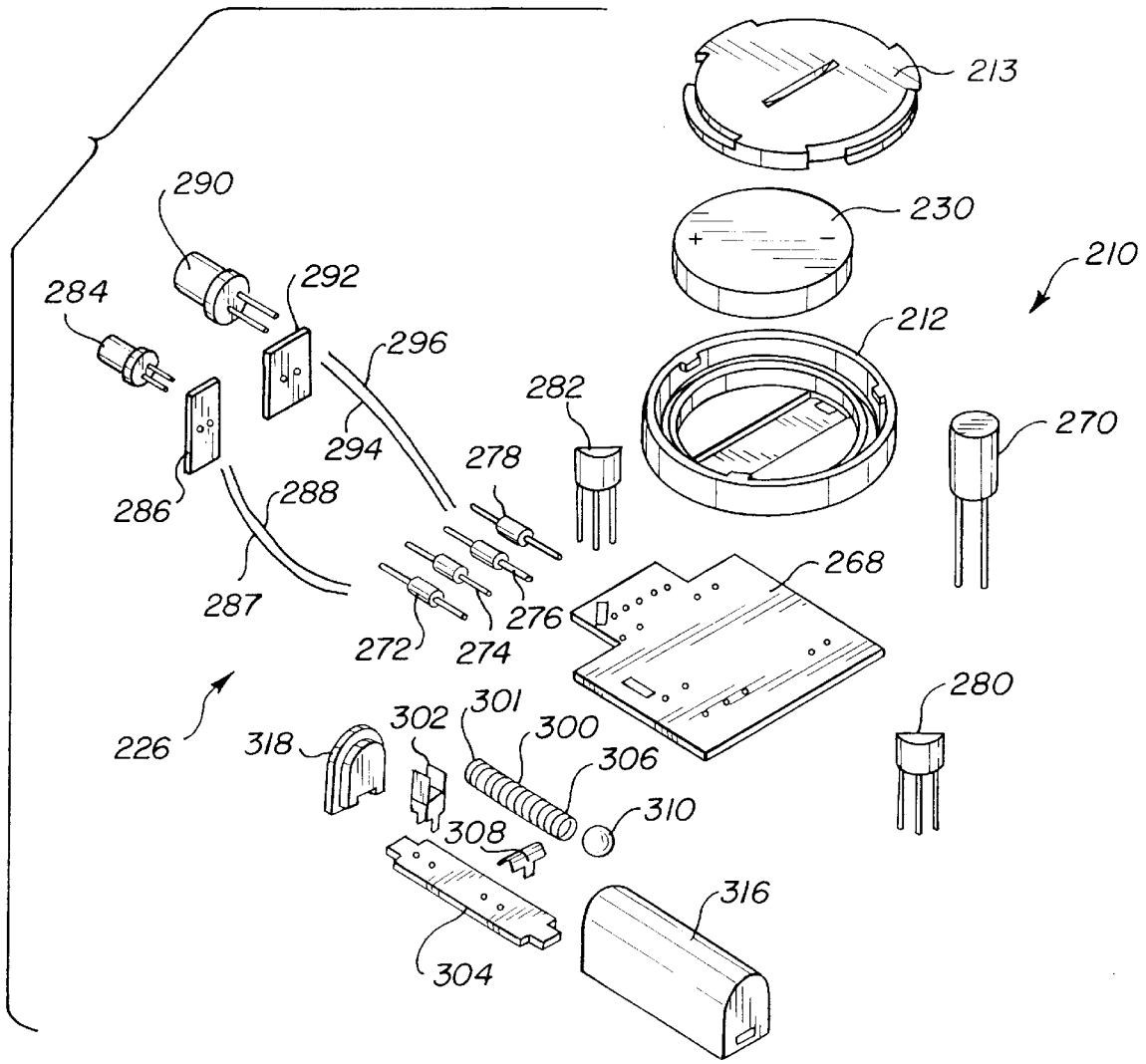
FIG. 7 is a fully exploded perspective view of a light module of FIG. 6.

Referring now to FIGS. 6 and 7, a light module 210 according to another embodiment of the invention will now be described in which the elements corresponding to light module 10 are identified and shown by the same reference numerals, augmented by 200.

As shown therein, in place of the two AAA batteries 30 and 31, there is provided a single lithium battery 230, which is provided in a circular housing 212 having a cover 213 secured thereto with a bayonet type closure. Housing 212 is mounted to the upper surface of printed circuit board 268 between the various circuit elements 270, 272, 274, 276, 280, 282 and 284 mounted on printed circuit board 268. Suitable contacts and/or electric wires are provided which connect battery 230 and/or housing 212 to the various circuit elements to power the same. Of course, a housing (not shown) would also be provided for housing all of the components of FIGS. 6 and 7.

It will be appreciated that the light source (LEDs) are shown apart from the module per se, although the LEDs can also be mounted in the module. In both cases, the LEDs are mounted to the footwear, either independently or as part of the module.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A light module for use with a light source mounted to footwear, comprising:

a power supply for supplying power;

a coil spring switch mounted in a cantilever manner so as to alternately electrically connect and disconnect power from said power supply to said light source in response to movement of said light module and having an open state and a closed state such that said light source is activated to emit light at a first illumination intensity when said coil spring switch is in said closed state; and a fading control circuit connected to the light source and the coil spring switch for controlling the supply of power to the light source when the coil spring switch changes from the closed state to the open state such that the illumination intensity of light emitted from the light source decreases over time to produce a fading effect.

2. A light module according to claim 1, wherein:

said fading control circuit includes a capacitive device which stores power from said power supply and which discharges the stored power, said capacitive device being connected with said light source to activate said light source; and said coil spring switch opens and closes a connection such that:

when said coil spring switch closes said connection, said capacitive device charges to a full capacity thereof as determined by said power supply, and said light source is activated to emit light at a first intensity in accordance with said full capacity of the charge on said capacitive device, and when said coil spring switch opens said connection, said capacitive device discharges from said full capacity thereof, and said light source is activated to emit light at an intensity less than said first intensity and which decreases over time, in accordance with said discharge, to produce a fading effect.

3. A light module according to claim 2, wherein said coil spring switch opens and closes a connection between said power supply and said capacitive device such that:

when said coil spring switch closes said connection, said capacitive device charges to a full capacity thereof as determined by said power supply, and said light source is activated to emit light at a first intensity in accordance with said full capacity of the charge on said capacitor, and when said coil spring switch opens said connection, said capacitive device discharges from said full capacity thereof, and said light source is activated to emit light at an intensity less than said first intensity and which decreases over time, in accordance with said discharge, to produce a fading effect.

4. A light module according to claim 3, wherein said coil spring switch intermittently provides electrical connection between said power supply and said capacitive device upon movement of said module, said coil spring switch having one end electrically connected to one of said capacitive device and said power supply and an opposite free end intermittently electrically connected with the other of said capacitive device and said power supply upon movement of said module, to provide said opening and closing of said coil spring switch.

5. A light module according to claim 4, further comprising a weight supported by said free end of said coil spring switch to enhance contact of said free end with a contact electrically connected with said other of said capacitive device and said power supply during said intermittent electrical connection.

6. A light module according to claim 4, wherein said coil spring switch is out of direct contact with said power supply.

7. A light module according to claim 3, further comprising a resistive device which determines a timing of said discharge from said capacitive device, said resistive device being connected between said capacitive device and said light source.

8. A light module according to claim 7, further comprising a driving transistor having an output path connected with said light source, and an input; and wherein said resistive device is connected between said capacitive device and the input of said driving transistor.

9. A light module according to claim 8, wherein:

said driving transistor has a base as the input and a collector-emitter path as the output path connected in series with said light source; and said resistive device includes:

a first resistive element connected between one terminal of said capacitive device and the base of the driving transistor, and a second resistive element connected between an opposite terminal of said capacitive device and the base of said driving transistor.

10. A light module according to claim 9, wherein said second resistive element is connected in parallel with a base-emitter path of said driving transistor.

11. A light module according to claim 3, wherein said power supply includes at least one battery.

12. A light module according to claim 3, wherein said light source includes at least one light emitting diode.

13. A light module according to claim 3, further including a housing which supports said power supply and which supports said coil spring switch at a position displaced from said power source.

14. A light module according to claim 2, wherein said coil spring switch alternatively opens and closes a connection between said power supply and said capacitive device upon movement of said module, such that:

when said coil spring switch closes said connection, said capacitive device charges to a full capacity thereof as determined by said power supply, and said light source is activated to emit light at a first intensity in accordance with said full capacity of the charge on said capacitive device, and when said coil spring switch opens said connection, said capacitive device discharges from said full capacity thereof, and said light source is activated to emit light at an intensity less than said first intensity and which decreases over time, in accordance with said discharge, to produce a fading effect; and further including a photosensor which senses ambient light and which prevents activation of said light source when said photosensor senses ambient light of an intensity greater than a predetermined intensity, regardless of whether said coil spring switch is open or closed.

15. A light module according to claim 14, wherein said photosensor includes:

a photoconductive sensor having an internal resistance of at least a first value when said ambient light is less than said predetermined intensity and which decreases from said first value with increasing intensity of said ambient light, and a first transistor for preventing activation of said light source in response to sensing of the intensity of aid ambient light greater than said predetermined intensity.

16. A light module according to claim 15, wherein:

said first transistor includes an output path connected between said light source and one terminal of said capacitive device, for supplying power to activate said light source, and an input, and said photoconductive sensor is connected across the output path of said first transistor, and has an input connected to the input of said first transistor, such that:

upon sensing the ambient light of an intensity less than said predetermined intensity, the photoconductive sensor has said internal resistance of at least said first value, to substantially prevent flow of current therethrough, whereupon current flows to the input of said first transistor to turn said first transistor on to permit the supply of power through the output path thereof and to activate said light source, and upon sensing the ambient light of an intensity greater than said predetermined intensity, the photoconductive sensor has said internal resistance less than said first value to permit flow of current therethrough, whereupon current flows primarily through said photoconductive sensor rather than through the input of said first transistor, and said first transistor is turned off to prevent the supply of power through the output path thereof to prevent activation of said light source.

17. A light module according to claim 16, further comprising:

a first resistive element connected between one output terminal of the first transistor and an input of said photoconductive sensor, and a second resistive element connected between another output terminal of the first transistor and an output of said photoconductive sensor.

18. A light module according to claim 16, further comprising a second transistor having an output path connected with said light source, and an input connected to the output path of said first transistor.

19. A light module according to claim 18, wherein said fading control circuit further includes a resistive device which determines a timing of said discharge from said capacitive device, said resistive device being connected between the output path of said first transistor and the input of said second transistor.

20. A light module according to claim 19, wherein said resistive device includes:

a first resistive element connected between the output path of said first transistor and the input of the second transistor, and a second resistive element connected between an opposite terminal of said capacitive device and the input of said second transistor.

21. A light module according to claim 14, wherein said coil spring switch is electrically connected to one of said capacitive device and said power supply and an opposite free end of said spring intermittently electrically connects with the other of said capacitive device and said power supply upon movement of said module, to provide said opening and closing of said coil spring switch.

22. A light module according to claim 21, further comprising a weight supported by said free end of said coil spring switch to enhance contact of said free end with a contact electrically connected with said other of said capacitive device and said power supply during said intermittent electrical connection.

23. A light module according to claim 21, wherein said coil spring switch is out of direct contact with said power supply.

24. A light module according to claim 14, wherein said power supply includes at least one battery.

25. A light module according to claim 14, wherein said light source includes at least one light emitting diode.

26. A light module according to claim 2, wherein said fading control circuit further includes a resistor circuit for determining a timing of said discharge from said capacitive device, said resistor circuit being connected between said capacitive device and said light source.

27. A light module according to claim 26, wherein said fading control circuit further includes a driving transistor having an output path connected with said light source, and an input; and said resistor circuit is connected between said capacitive device and the input of said driving transistor.

28. A light module according to claim 27, wherein:

said driving transistor has a base as the input and a collector-emitter path as the output path connected in series with said light source; and said resistor circuit includes:

a first resistive element connected between one terminal of said capacitive device and the base of the driving transistor, and a second resistive element connected between an opposite terminal of said capacitive device and the base of said driving transistor.

29. A light module according to claim 1, wherein said coil spring switch intermittently provides electrical connection upon movement of said module, and said coil spring switch has one end electrically connected to one of said fading control circuit and said power supply and an opposite free end intermittently electrically connected with the other of said fading control circuit and said power supply upon movement of said module, to provide said opening and closing of said coil spring switch.

* * * * *